US007294235B2

(12) United States Patent
Hamel

(10) Patent No.: US 7,294,235 B2
(45) Date of Patent: Nov. 13, 2007

(54) SUPERCALENDERING OPTIMIZATION USING A STEAM SHOWER

(75) Inventor: Robert G. Hamel, British Columbia (CA)

(73) Assignee: ABB Ltd., Dublin (IR)

( * ) Notice: Subject to any disclaimer, the term of this patent is extended or adjusted under 35 U.S.C. 154(b) by 160 days.

(21) Appl. No.: 10/208,643

(22) Filed: Jul. 30, 2002

(65) Prior Publication Data

US 2004/0020619 A1 Feb. 5, 2004

(51) Int. Cl.
*D21F 3/02* (2006.01)

(52) U.S. Cl. ..... 162/206; 162/207; 162/193; 162/224; 162/290; 100/38; 100/41; 34/114; 34/124

(58) Field of Classification Search ..... 162/207, 162/205, 206, 361, 204; 427/8, 366, 361, 427/377; 100/38, 73, 74, 304, 75; 34/448, 34/465

See application file for complete search history.

(56) References Cited

U.S. PATENT DOCUMENTS 6,073,549 A * 6/2000 Winheim et al. ..... 100/74
2001/0008181 A1* 7/2001 Anderson ..... 162/204

FOREIGN PATENT DOCUMENTS

PL 121 374 9/1983
WO WO 00/79049 * 12/2000

OTHER PUBLICATIONS

Klepaczka and Tarnawski "One-Sided Gloss-Calendering of Paper" (NDN 188-0117-2655-0) Przeglad Papier. 37, No. 7/8: 259-261 (Jul./Aug. 1981).

* cited by examiner

*Primary Examiner*—Mark Halpern
(74) *Attorney, Agent, or Firm*—Michael M. Rickin; Paul R. Katterle

(57) ABSTRACT

There is described a method and apparatus for applying steam from a steam source to a moving web to thereby improve the smoothness and gloss of the web. A housing has at least one cooling chamber upstream and at least one steam chamber downstream. The cooling air in the cooling chamber is used to cool the web before steam is applied to the web from the steam chamber. This allows a sufficient volume of steam to be delivered to the web to thereby raise its moisture content to a desired level to thus achieve optimized calendering of the web.

18 Claims, 2 Drawing Sheets

SUPERCALENDERING OPTIMIZATION USING A STEAM SHOWER

FIELD OF THE INVENTION

This invention relates to an apparatus and method to effectively deliver hot steam to a web of paper, and more specifically to an apparatus and method intended for efficient use of steam shower with a supercalender to improve the smoothness and gloss of the paper.

DESCRIPTION OF THE PRIOR ART

Supercalenders are employed in the papermaking industry to improve the smoothness or gloss of the surface finish of a paper web. The supercalendering process is intended for certain high quality printing papers in which it is necessary to improve the surface properties beyond that produced on the basic papermaking machine.

The supercalender consists of a stack of rolls forming multiple press nips through which the paper sheet is passed. Alternate rolls have "soft" surfaces and are stacked between hard metal rolls. Because the hard rolls normally have smaller diameters than that of the soft rolls, the press nip formed between the rolls deforms the soft roll creating an extended nip surface on the soft roll. The surfaces of the soft rolls deform as the rolls turn and the paper sheet enters into the nip and again passes out of the nip. The important deformation is relative to the surface of the hard roll that has a relatively larger curvature. Thus as a paper sheet is passed through the nip, it experiences a small relative "sliding" or "expanding" of the soft roll surface on the paper sheet surface. This modifies the surface with little or no effect on the bulk of the paper sheet and improves properties such as gloss and smoothness.

The effect is one sided in that only the surface contacted by the soft roll is modified. To create a two sided effect, the supercalender stack will put two similar rolls together in the middle such that the upper stack will present soft rolls to one side of the paper sheet and the lower stack will present soft rolls to the other side of the paper.

It has been found that changes in moisture and temperature have an additional supercalendering effect on the paper sheet as it passes through the stack. Since the desired effect is on the surface of the paper, it is the surface temperature and surface moisture of the paper that is important.

In the production of paper, steam can be used to modify the moisture content and temperature of the paper web. Equipment used to add the steam to the paper web is generally referred to as a steam shower. Steam showers can be used successfully on the supercalendering process as long as careful attention is paid to the volume of steam delivered. The steam that condenses on the paper web serves to increase both the temperature and moisture content of the web. In fact, condensing steam on the paper is one of the best methods of adding moisture evenly and without "mottling" the surface.

Nevertheless, steam showers used in this application can only offer limited benefits because of the limited capability of the sheet to condense the steam on its surface. It has been found the sheet cannot condense more steam on its surface after the temperature on the sheet surface exceeds a certain threshold value.

Klepaczka and Tarnawski disclose in Polish patent No. 121374 and the related Journal article "One-Sided Gloss-Calendering of Paper" (NDN 188-0117-2655-0) published in Przeglad Papier. 37, no. 7/8: 259-261 (July/August 1981) a configuration that uses two cylinders in contact with the paper web upstream of a steam shower to cool the web. The authors claim that the temperature of the web with 95% dryness must be in the range of 35 to 50° C. before the steam shower in order to achieve effective performance from the steam treatment. The patent and the article do not further describe either the cylinders or the method of cooling.

Standard papermaking machines do not include cooling cylinders. Therefore while cooling the web by using such cylinders is effective, it involves a structural modification of the papermaking machine and is complicated in construction and consequently expensive.

Thus it would be desirable to cool the paper web by a method and apparatus that does not involve a structural modification of the papermaking machine. The present invention accomplishes that result without a structural modification of the papermaking machine and therefore is more cost effective than the prior art.

The present invention cools the paper web by applying cooling air across the web surface before the steam treatment. The cooling air may be applied by using either a vacuum or a blower.

One of the benefits of the present invention is to allow the paper maker to use conventional steam shower technology on hot inline supercalenders where the web is too hot to use the steam showers without pre-cooling.

Another benefit of the present invention is the optimized efficiency of the steam showers. The cooler paper web condenses more steam on its surface to allow maximized supercalendering effect. Moisture saturation resulting from surface temperature over the threshold value at the sheet surface causes excessive steam to escape to the atmosphere and makes the steam shower less efficient. Cooling down the sheet before applying steam extends the temperature range for steam treatment and delays the moisture saturation due to reaching the temperature limitation on the paper surface. Maximized efficiency of the steam shower results in either higher gloss or smoothness of the paper products, or the capability to achieve targeted gloss or smoothness with less nips or rolls.

Yet another benefit of the present invention is to separate sheet moisture control from sheet temperature control. By controlling the moisture level on the paper surface, one can make sure that the optimization of the supercalendering effect is achieved.

SUMMARY OF THE INVENTION

A method for controlling the moisture of a web comprising:

(a.) providing an application device;

(b.) moving the web relative to the application device so as to define at least one cooling gap therebetween;

(c.) moving cooling air through the at least one cooling gap and across the moving web to cool the moving web; and (d.) applying steam to the cooled moving web to increase the moisture content of the moving web; and wherein the application device comprises a vacuum source and a housing with a cooling chamber, and wherein the step of moving cooling air comprises using the vacuum source to draw cooling air through the at least one cooling gap and into the cooling chamber, and wherein tho web is comprised of paper and the method is performed in a supercalendering process.

A method for controlling the moisture of a web comprising:

(a.) providing an application device comprising a cooling chamber, and a steam chamber, wherein the cooling chamber is disposed upstream from the steam chamber, and wherein the cooling chamber and the steam chamber are disposed on opposing sides of the application device;

(b.) moving the web relative to the application device so as to define at least one cooling gap and at least one steam gap therebetween, said at least one steam gap being disposed proximate to the steam chamber and said at least one cooling gap being disposed proximate to the cooling chamber;

(c.) moving cooling air through the at least one cooling gap and across the moving web to cool the moving web, said step of moving cooling air comprising moving cooling air into or out of the cooling chamber; and (d.) applying steam to the cooled moving web to increase the moisture content of the moving web, said step of applying steam comprising delivering steam into the at least one steam gap via the steam chamber.

A method for controlling the moisture of a web in a supercalendering process comprising:

(a.) providing an application device;

(b.) moving the web relative to the application device so as to define at least one cooling gap therebetween;

(c.) moving cooling air through the at least one cooling gap and across the moving web to cool the moving web;

(d.) changing the direction of the cooled moving web; and (d.) after changing the direction of the cooled moving web, applying steam to the cooled moving web to increase the moisture content of the moving web.

DESCRIPTION OF THE PREFERRED EMBODIMENT(S)

Figure 1:
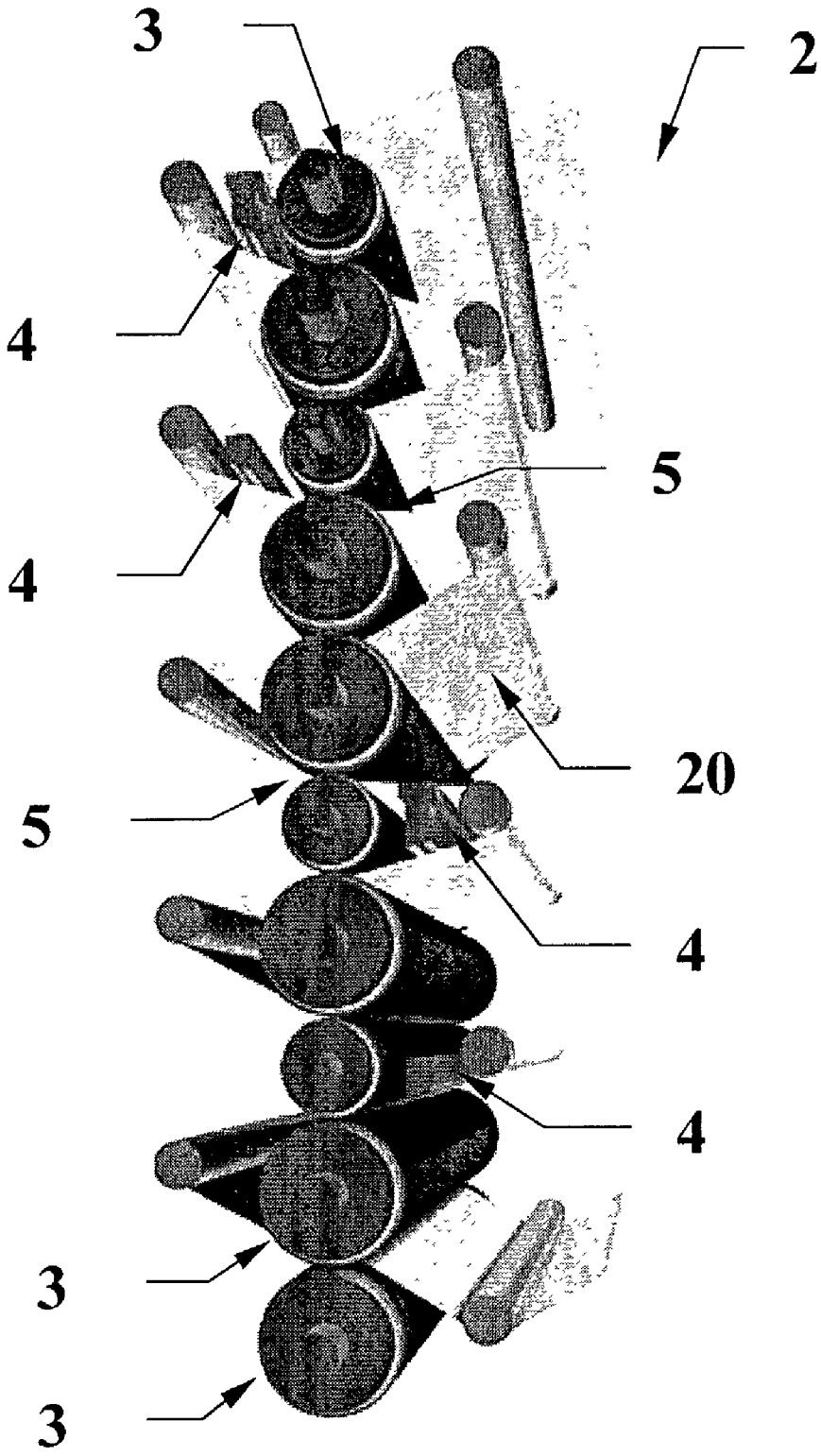
FIG. 1 shows a schematic view of a supercalender incorporating the steam application device of the present invention.

FIG. 1 shows a supercalender arrangement. 2 that incorporates the stationary steam application device 4 of the present invention. The supercalender arrangement 2 comprises a series of stacked rolls 3 that forms multiple press nips 5. As is also conventional, the steam application device 4 extends in the cross-machine direction across the width of the paper web 20 to deliver steam to the paper web 20 as it moves past the device immediately before entering the nip 5 between two rollers to undergo supercalendering.

Figure 2:
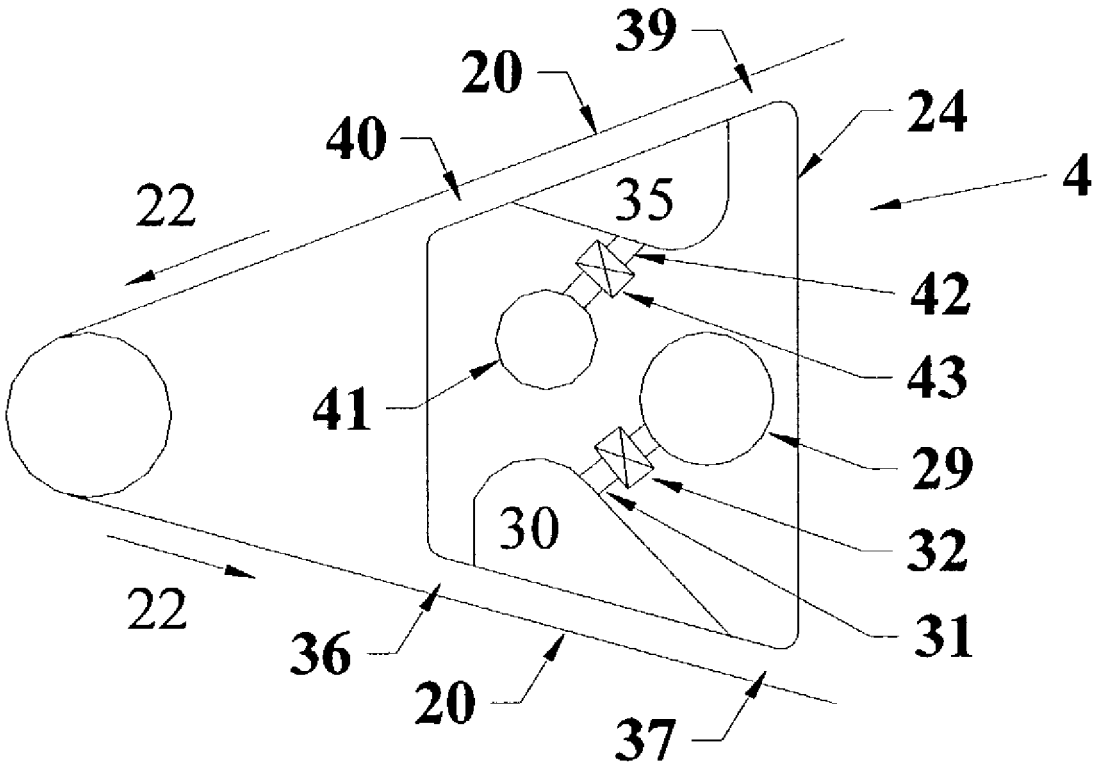
FIG. 2 shows a detailed schematic view of a preferred embodiment for the steam application device of the present invention.

FIG. 2 is a detailed section view of steam application device 4 showing schematically the cross-sectional structure of a preferred embodiment of that device. The paper web 20 moves in the direction indicated by arrow 22 past the stationary device 4. The device 4 includes a housing 24 having a cooling chamber 35 and a steam chamber 30 positioned adjacent the moving paper web 20. The cooling chamber 35 is located upstream of the steam chamber 30, indicating that the web sheet 20 is cooled down by cooling air from chamber 35 before heated by the steam from chamber 30.

The cooling chamber 35 includes means for moving cooling air over paper web 20 to lower the temperature of the web. The means for moving cooling air preferably comprises a vacuum source for drawing cooling air in the environment into the cooling chamber 35 or a fan unit for blowing cooling air into the cooling chamber 35. Referring to FIG. 2, there is shown a main passage 41 for moving air that communicates with the vacuum source (not shown) or the fan unit (not shown). The main passage 41 includes an opening 42 that communicates with cooling chamber 35.

If a vacuum source is used, the source is sized to generate sufficient negative pressure in main passage 41 to draw outside cooling air through two gaps 39 and 40 across the web surface and into cooling chamber 35 to cool down the web 20. The two gaps 39 and 40 are defined by the spaces between the web sheet surface and the surface of the housing 24 around the cooling chamber 35. If a fan unit is used, the unit is sized to blow air through main passage 41, into the cooling chamber 35 and out through the two gaps 39 and 40.

Cooling chamber 35 can be a single chamber extending across the housing in the cross-machine direction to generate a substantially uniform sheets of cooling air that move over the paper web 20 through the gaps 39 and 40. Alternatively, chamber 35 can be a plurality of cooling chambers extending across the housing in the cross-machine direction to define discrete control zones. An air flow valve 43 is associated with each cooling chamber to control the flow of air created by positive or negative pressure in main passage 41. A conventional feedback control scheme (not shown) permits adjustment of the cooling air flow at each cooling chamber 35 via the air flow valve 43 to create a consistent or desirable temperature profile across the paper web 20.

Extending through housing 24 there is another main supply header 29 in communication with a steam source (not shown). The main supply header 29 distributes steam from the steam source to the at least one steam chamber via outlet 31 to apply heat and moisture to the web between two gaps 36 and 37. The two gaps 36 and 37 are defined by spaces between the web sheet surface and the surface of the housing 24 near the steam chamber 30.

Preferably, a steam flow valve 32 controls the flow of steam from the main supply header 29 to steam chamber 30. As in conventional steam application devices, there is normally a plurality of steam chambers 30 extending across the housing in the cross-machine direction. Each steam chamber has its own associated steam flow valve 32 for independently delivering a controlled flow of steam to the region or zone of the paper web 20 beneath the chamber 30.

In a conventional feedback control scheme, downstream scanners can measure properties across the width of the paper web 20 and provide feedback to a controller (not shown). The controller is able to independently adjust the steam flow valves 32 to modify the properties of the sheet 20 in various zones to establish a consistent properties profile across the entire paper web 20.

As is described above, the method and apparatus of the present invention cools down the paper web 20 before applying conventional steam treatment using steam showers. The present invention allows traditional steam showers to deliver sufficient steam into contact with the paper web 20 in the confined area of the steam chamber 30 to raise the moisture content of the web, without raising the temperature of the web beyond accepted working levels for supercalendering. As a result of raising the moisture content as desired, supercalendering optimization can be achieved.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A method for controlling the moisture of a web comprising:

(a.) providing an application device;

(b.) moving the web relative to the application device so as to define at least one cooling gap therebetween;

(c.) moving cooling air through the at least one cooling gap and across the moving web to cool the moving web; and (d.) applying steam to the cooled moving web to increase the moisture content of the moving web; and wherein the application device comprises a vacuum source and a housing with a cooling chamber, and wherein the step of moving cooling air comprises using the vacuum source to draw cooling air through the at least one cooling gap and into the cooling chamber;

wherein the web is comprised of paper and the method is performed in a supercalendering process; and wherein the application device further comprises a steam chamber and wherein moving the web relative to the application device further defines at least one steam gap therebetween, and wherein the step of applying steam comprises delivering steam into the at least one steam gap via the steam chamber.

2. The method of claim 1, wherein the application device comprises a plurality of cooling chambers and a plurality of steam chambers, and wherein the at least one cooling gap comprises a plurality of cooling gaps and the at least one steam gap comprises a plurality of steam gaps.

3. The method of claim 1, further comprising changing the direction of the cooled moving web before the step of applying steam to the cooled moving web.

4. A method for controlling the moisture of a web comprising:

(a.) providing an application device comprising a cooling chamber and a steam chamber, wherein the cooling chamber is disposed upstream from the steam chamber, and wherein the cooling chamber and the steam chamber are disposed on opposing sides of the application device;

(b.) moving the web relative to the application device so as to define at least one cooling gap and at least one steam gap therebetween, said at least one steam gap being disposed proximate to the steam chamber and said at least one cooling gap being disposed proximate to the cooling chamber;

(c.) moving cooling air through the at least one cooling gap and across the moving web to cool the moving web, said step of moving cooling air comprising moving cooling air into or out of the cooling chamber; and (d.) applying steam to the cooled moving web to increase the moisture content of the moving web, said step of applying steam comprising delivering steam into the at least one steam gap via the steam chamber.

5. The method of claim 4, wherein the web is comprised of paper and the method is performed in a supercalendering process.

6. The method of claim 5, wherein the application device further comprises a fan, and wherein the step of moving cooling air comprises using the fan to blow cooling air into the at least one cooling gap.

7. The method of claim 5, wherein the application device further comprises a vacuum source, and wherein the step of moving cooling air comprises using the vacuum source to draw cooling air through the at least one cooling gap and into the cooling chamber.

8. The method of claim 5, wherein the application device comprises a plurality of cooling chambers and a plurality of steam chambers, and wherein the at least one cooling gap comprises a plurality of cooling gaps and the at least one steam gap comprises a plurality of steam gaps.

9. The method of claim 5, further comprising changing the direction of the cooled moving web before the step of applying steam to the cooled moving web.

10. A method for controlling the moisture of a web in a supercalendering process comprising:

(a.) providing an application device;

(b.) moving the web relative to the application device so as to define at least one cooling gap therebetween;

(c.) moving cooling air through the at least one cooling gap and across the moving web to cool the moving web;

(d.) changing the direction of the cooled moving web; and (d.) after changing the direction of the cooled moving web, applying steam to the cooled moving web to increase the moisture content of the moving web.

11. The method of claim 10, wherein the application device comprises a fan, and wherein the step of moving cooling air comprises using the fan to blow cooling air into the at least one cooling gap.

12. The method of claim 11, wherein the application device further comprises a housing having a cooling chamber, and wherein the step of moving cooling air comprises using the fan to blow cooling air into the cooling chamber and out into the at least one cooling gap.

13. The method of claim 10, wherein the application device comprises a vacuum source and a housing with a cooling chamber, and wherein the step of moving cooling air comprises using the vacuum source to draw cooling air through the at least one cooling gap and into the cooling chamber.

14. The method of claim 10, wherein the application device comprises a cooling chamber and a steam chamber and wherein moving the web relative to the application device further defines at least one steam gap therebetween, said steam gap being disposed proximate to the steam chamber and said cooling gap being disposed proximate to the cooling chamber, and wherein the step of applying steam comprises delivering steam into the at least one steam gap via the steam chamber.

15. The method of claim 14, wherein the step of moving cooling air through the at least one cooling gap comprises moving cooling air into or out of the cooling chamber.

16. The method of claim 15, wherein the cooling chamber is disposed upstream from the steam chamber, wherein the cooling chamber and the steam chamber are disposed on opposing sides of the application device.

17. The method of claim 14, wherein the application device comprises a plurality of cooling chambers and a plurality of steam chambers, and wherein the at least one cooling gap comprises a plurality of cooling gaps and the at least one steam gap comprises a plurality of steam gaps.

18. The method of claim 10, wherein the moving web travels above and below the application device.

* * * * *